United States Patent [19]

Westfelt

[11] Patent Number: 4,984,596

[45] Date of Patent: Jan. 15, 1991

[54] OPERATING DEVICE FOR A DISH-WASHER

[75] Inventor: Jan A. N. Westfelt, Huskvarna, Sweden

[73] Assignee: Aktiebolaget Electrolux, Stockholm, Sweden

[21] Appl. No.: 408,709

[22] Filed: Sep. 18, 1989

[30] Foreign Application Priority Data

Sep. 22, 1988 [SE] Sweden ..... 8803361

[51] Int. Cl.[5] ..... B08B 3/02

[52] U.S. Cl. ..... 134/58.0 DL; 222/651; 222/652

[58] Field of Search ..... 222/651, 652; 134/57 DL, 58 DL

[56] References Cited

U.S. PATENT DOCUMENTS 3,125,249 3/1964 Kenot ..... 222/652
3,411,671 11/1968 Harvey et al. ..... 222/652
3,811,600 5/1974 Allison et al. ..... 222/652
4,149,656 4/1979 Nelson ..... 222/652

FOREIGN PATENT DOCUMENTS 0076409 4/1983 European Pat. Off. .
440383 2/1979 Sweden .

*Primary Examiner*—Frankie L. Stinson
*Attorney, Agent, or Firm*—Pearne, Gordon, McCoy & Granger

[57] ABSTRACT

A receptacle for containing a powdered detergent is arranged in the door of a dishwasher having a washing chamber. The receptacle has an opening which, when the door is closed, is situated inside the door and faces the washing chamber. The opening can be closed by a lid which can be locked in a closed position by a lock hook which engages a projection on the lid. The lock hook can be acted on in order to release the lid for movement to an open position by an electric means arranged in the dishwasher. A mechanical means in the door is arranged to transmit movement form the electric means to the lid in order to open it.

3 Claims, 2 Drawing Sheets

OPERATING DEVICE FOR A DISH-WASHER

BACKGROUND OF THE INVENTION

This invention relates to dishwashing machines, and more particularly to an operating device for causing the lid covering a powdered dishwashing soap receptacle to open.

Dishwashers of this type generally consist of a tub appropriately mounted upon a frame. The tub has an opening which accesses a washing chamber in which the washing is performed. Both the tub and the frame are enclosed within a cabinet. The cabinet has a hinge along its bottom edge to which a door is mounted. When the door is closed the tub opening is covered and the washing cycle may begin. The dishwasher door has a receptacle for holding detergent prior to and during part of the washing cycle. The receptacle has an opening facing the washing chamber when the dishwasher door is closed and which, during the initial stage of the washing procedure, is covered by a lid releasable by electric means.

In most dishwashers of this type there is a receptacle for holding powdered detergent located in the dishwasher door. By such an arrangement it is easy to fill the detergent into the receptacle since when the dishwasher door is open it is horizontal and the opening of the receptacle is directed upwards. After filling the detergent into the receptacle it is covered by a lid which is kept in the closed position by a lock means. The lock means is usually releaseable by an electric means connected to a program controller arranged int eh dishwasher which controls the washing cycle. Often an electromagnetic solenoid, which is mounted in the dishwasher door, is used as the electric means and the core of the solenoid releases the lock means when the solenoid is activated. The electromagnetic solenoid is automatically activated by the program controller at the proper time during the washing cycle.

A disadvantage with this arrangement is that the cables for the electromagnet have to bridge the gap between the dishwasher door and the cabinet of the dishwasher. This often leads to wear problems since the door is rotatable on a hinge and must be opened each time dishes are inserted into or taken out of the washing chamber. Prolonged wear and tear from the unavoidable strechings and bendings to which the cables are exposed can create short circuits or breaks of the cables which result in a safety risk.

SUMMARY OF THE INVENTION

It is a purpose of this invention to avoid the disadvantage described above by utilizing an operating device where no cables need to be installed in the dishwasher door. Such an operating device has a mechanical means mounted within the dishwasher door and an electrical means mounted behind the front face of the dishwasher cabinet. When the electrical means is activated by the program controller it cooperates with the mechanical means causing the receptacle lid to open.

Another purpose of the invention is to make it possible to manually open the lid of the detergent receptacle if it is closed unintentionally or if a current interruption or failure should occur in the dishwasher thereby not permitting the lid to be released by the electric means.

The dishwasher door is hinged to the dishwasher cabinet along its bottom edge and can be latched to the cabinet along its top edge when closed. When the dishwasher door is closed and latched it covers the tub opening and form a seal along the perimeter of the door between the door and the tub opening. Also, when the door is closed the powdered soap receptacle located on the inside panel of the dishwasher door is inside the tub opening and faces the washing chamber. Thus, in order to activate the mechanical means thereby causing the lid covering the said receptacle to open it is necessary to have one end of the mechanical means in working engagement with the lid and the other end displaced a distance therefrom and in working cooperation with the electric means, such as an electromagnetic solenoid, housed within the dishwasher cabinet.

According to the preferred embodiment of the invention, an L-shaped rod is mounted between the outside panel and inside panel of the dishwasher door and is turnable about its vertical axis when the door is closed. The upper end of the L-shaped rod has a follower perpendicularly connected thereto. The follower has an arm extending toward the lower end of the L-shaped rod and is substantially parallel with the vertical axis of the rod. The arm movingly cooperates with a longitudinally displaceable shaft movably supported by a sleeve disposed within the inner panel of the dishwasher door. When the dishwasher door is closed the end of the shaft facing the dishwasher frame is adjacent the moveable rod of an electromagnet and is coaxial therewith. The electromagnetic solenoid is housed within the dishwasher cabinet and the moveable core or rod of the solenoid s extendable through an aperture in the front face of the cabinet.

The lower end of the L-shaped rod extends through an aperture in the inner panel of the dishwasher door and is shaped like a hook so it workingly engages a projection on the lid covering the powdered soap receptacle. The hook shaped end of the L-shaped rod extends into the tub opening and is exposed to water during the washing cycle. Preferably, a below shaped seal is provided in the aperture through which the lower end of the L-shaped rod extends to prevent water from entering the area between the outside panel an the inside panel of the dishwasher door.

When the washing cycle is in operation the program controller of the dishwasher sends an activating signal to the solenoid when it is time to open the lid covering the powdered soap receptacle. When the solenoid is activated the core moves longitudinally thereby engaging the shaft and longitudinally displacing it. The shaft then movingly cooperates with the arm of the follower causing the L-shaped rod to rotate clockwise along its vertical axis. The rotation causes the hook end of the L-shaped rod to disengage from the projection on the lid covering the powdered soap receptacle thereby opening the lid which is under tension from a spring connected therewith. When the moveable core of the electromagnet is retracted thereby becoming disengaged from the shaft the L-shaped rod rotates counterclockwise so that the hook shaped end is in position to engage the projection on the lid when the lid is closed. At the same time, the shaft is longitudinally displaced by the arm to a position where the end of the shaft facing the dishwasher cabinet is adjacent the end of the moveable rod with which it cooperates. This rotation is caused by a spring located on the upper end of the L-shaped rod which cooperates with the follower thereby exerting a constant counterclockwise rotational force on the L-shaped rod.

As appears from the embodiment described the lid covering the detergent receptacle can be acted on by an electric operating device without installing any electrical cables between the door and the cabinet of the dishwasher. Another advantage with respect to known devices having electrically activated dishwasher dispensing arrangements in the door, is that the lid for the dispenser can be opened manually if it should be closed by mistake or if a current breakage or a technical failure should occur in the machine. This is achieved by manually pressing the shaft logitudinally toward the outer panel of the door when the door is open.

DESCRIPTION OF THE PREFERRED EMBODIMENT

Figure 1:
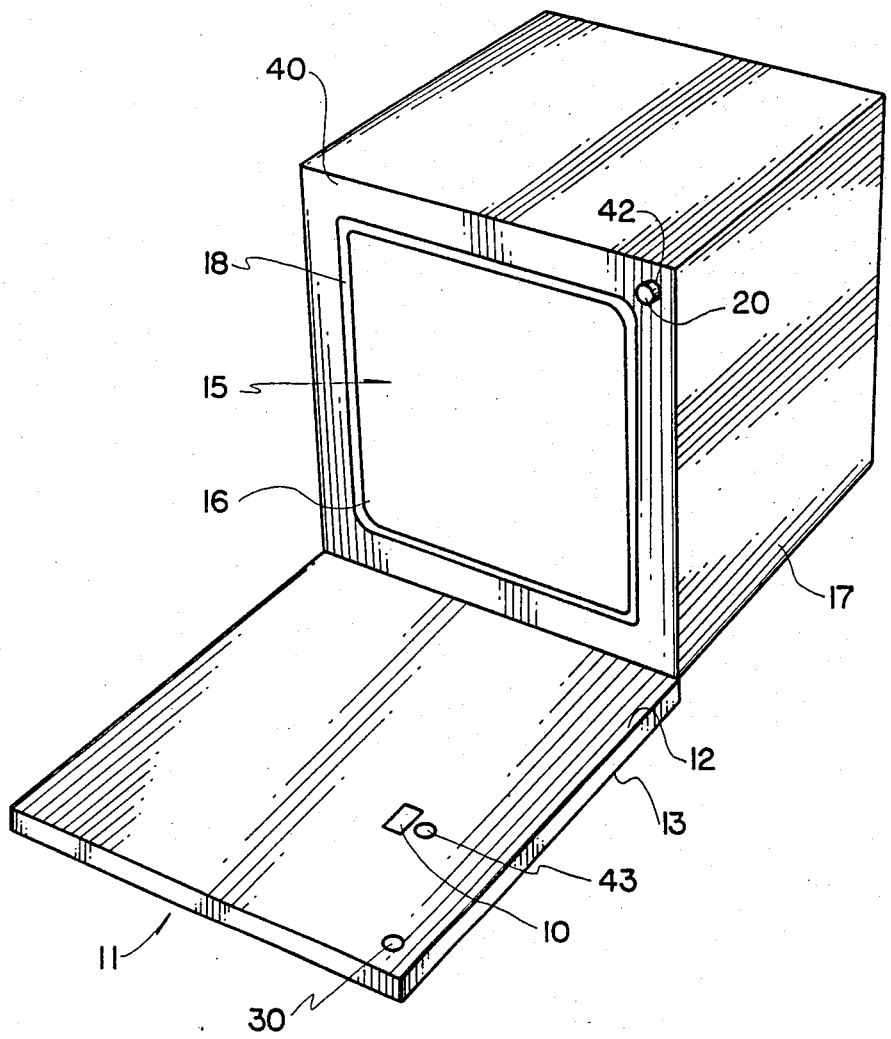
FIG. 1 is a perspective view of a dishwasher with the dishwasher door in its open position.

Referring to FIG. 1, there is shown a detergent receptacle 10 for containing powdered type detergent prior to and during part of the washing cycle. The receptacle 10 is mounted on the inside of the door 11. The door 11 is comprised of an outer door panel 12 and an inner door panel 13 which together form a space 14 there between. The door 11 is hinged or otherwise connected along its lower edge to the cabinet 17. The cabinet 17 has housed therein a tub which forms the washing chamber 16. The tub opening 15 exposes the washing chamber 16 when the door 11 is in its open position. When the door 11 is closed the tub opening 15 is covered. Perimetrically disposed around tub opening 15 is a flange 18 serving as a sealing means between the closed door 11 and the washing chamber 16. In the area between the sealing flange 18 and the edge of the cabinet 17 there is a front face 40. The front face 40 is wide enough to allow an electromagnetic solenoid 19 to be mounted behind it. The solenoid 19 could be mounted to the dishwasher frame or otherwise connected to the cabinet 17. The movable core 20 of the solenoid 19 extends through an aperture 42 in the front face of the cabinet 17 and is perpendicular to the sealing plane formed between the flange 18 and the door 11.

Figure 2:
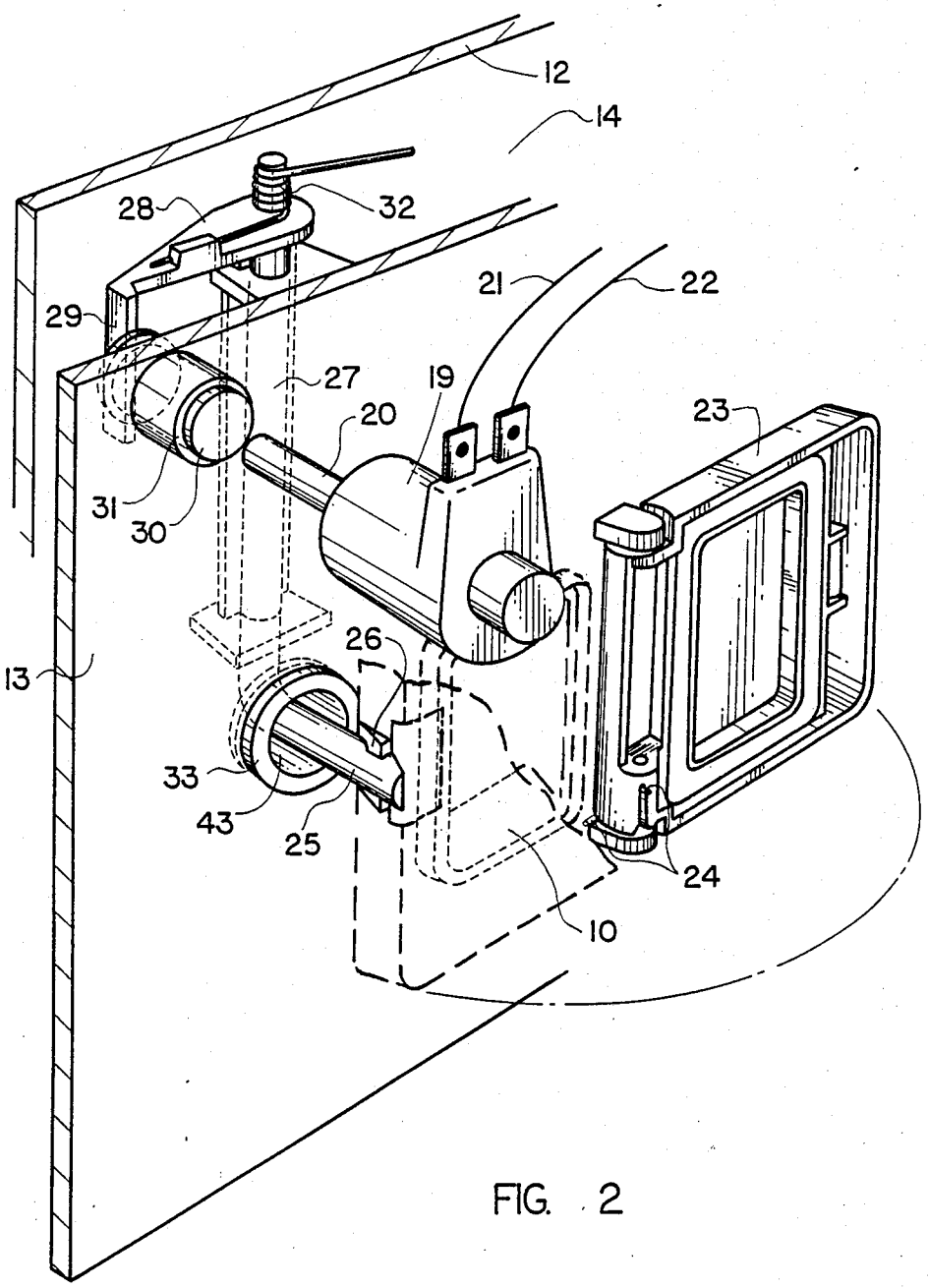
FIG. 2 is a perspective view of the location and relative positions of the elements comprising the preferred embodiment of the invention, and of the elements with which the preferred embodiment of the invention cooperates.

Referring to FIG. 2, the solenoid 19 is connected to a program controller, not shown, which controls the washing cycle via two conduits 21,22. The receptacle 10 can be covered by a lid 23 which is rotatably mounted adjacent thereto. The solenoid is electrically activated by the program controller during that portion of the washing cycle when the lid 23 is to be opened thereby exposing the powdered soap contained in the receptacle the 10.

Referring again to FIG. 2, the lid 23 is shown in its open position to which it is pre-stressed by a spring 24. As has been indicated in FIG. 2 the lid 23 can, against the action of the spring, be turned to a closed position where it is kept by the hook 25 engaging a projection 26 on the lid 23. The hook 25 is one end part of the L-shaped rod 27 which is turnable about a vertical axis when the door 11 is in its closed position. The opposite end of the L-shaped rod 27 is rigidly secured to a follower 28 which is provided with an arm 29. The arm 29 is rigidly connected to the follower 28 and is directed toward the opposite end of the L-shaped rod 27. The arm 29 is substantially parallel to the vertical axis of the L-shaped rod 27 and is placed in the longitudinal path of movement of a shaft 30. The shaft 30 is movably supported by a sleeve 31 which is mounted in an aperture within the inner door panel 13 thereby forming a lead-through connection. When the door 11 is closed, the shaft 30 and the movable core 20 of the solenoid are coaxial, and the cooperating ends of the shaft 30 and the moveable core 20 are placed a small distance from each other.

A spring 32 pre-stresses the follower 28 in the counter-clockwise direction as shown in FIG. 2 so that the arm 29 is in engagement with the shaft 30. At the same time, the hook 25 is positioned so that if the lid 23 is turned to a closed position the hook 25 engages the projection 26 thereby keeping the lid 23 closed. In order to release the lid 23 the solenoid 19 is activated by the program controller whereby the movable core 20 acts on the shaft 30 which moves the arm 29 causing the L-shaped rod 27 to rotate clockwise on its vertical axis and hence move the hook 25 so that it disengages from the projection 26 thus releasing the lid 23.

As is shown in FIG. 2, the hook 25 extends into the wet area of the dishwasher through aperture 43 and a bellow shaped seal 33 is arranged in the inner door panel 13 to form a sealed lead-through channel for the hook 25.

While the preferred embodiment of this invention has been shown and described in detail, it is recognized that various modifications and rearrangements may be resorted to without departing from the scope of the invention as defined in the claims.

I claim:

1. In a dishwasher having a wash cycle, a tub defining a washer chamber, said tub being disposed within a frame and enclosed by a cabinet, a door provided with a receptacle adapted to contain dishwashing detergent, said receptacle having an opening which faces said washing chamber when said door is in its closed position, said receptacle being covered by a lid prior to and during an initial stage of said wash cycle, an electric means having a movement, said lid being released by said electric means, an operating device, comprising:

said electric means disposed in association with said washing chamber;

a mechanical means for transferring said movement from said electric means to said lid when said door is in its closed position whereby said lid is released, said mechanical means being disposed within said door;

said lid being under the tension of a spring and being moved to a closed position in which it is retained by a lock means, said lock means releasing said lid when said mechanical means transfers said movement from said electric means to said lid;

said washing chamber being surrounded by a flange which sealingly cooperates with said door, said flange defining a boundary along its perimeter having an inside and an outside, said receptacle and said lid being situated inside said boundary when said door is in its closed position;

said electric means comprising an electromagnet and a movable core situated on the outside of said boundary, said movable core being substantially perpendicular to said door when said door is in its closed position;

said mechanical means comprising a shaft movable coaxially with said movable core; and said mechanical means including a rod turnable about a vertical axis when said door in its closed position, one end of said rod being shaped as a hook and extending into said washing chamber, said hook cooperating with a projection on said lid whereby said lid is locked in a closed position, the opposite end of said rod being provided with a follower having an arm, said arm being placed in the path of movement of said shaft, said shaft being acted upon by said movable core when said electric means is activated.

2. An operating device as recited in claim 1, wherein a biasing means is arranged to turn said rod and said hook whereby said hook engages said projection and simultaneously therewith said shaft is moved to a position adjacent the cooperating end of said moveable core.

3. An operating device as recited in claim 2, wherein said door comprises an inner panel and an outer panel disposed adjacent one another thereby creating a space therebetween, said mechanical means disposed within said space, said rod end shaped as a hook extending through an aperture in said inner panel, said aperture having a bellow seal disposed therein between said rod and the perimeter of said aperture.

* * * * *

UNITED STATES PATENT AND TRADEMARK OFFICE

CERTIFICATE OF CORRECTION

PATENT NO. : 4,984,596

DATED : January 15, 1991

INVENTOR(S) : Westfelt

It is certified that error appears in the above-identified patent and that said Letters Patent is hereby corrected as shown below:

On the cover page, delete title, and insert --ADDITIVE DISPENSING MECHANISM FOR A DISHWASHER--.

Column 1, line 2, delete title and insert --ADDITIVE DISPENSING MECHANISM FOR A DISHWASHER-- (centered).

Column 4, line 36, delete "washer" and insert --washing--.

Signed and Sealed this

Twenty-sixth Day of May, 1992

*Attest:*

DOUGLAS B. COMER

*Attesting Officer*

*Acting Commissioner of Patents and Trademarks*